US007383157B1

(12) United States Patent
Park et al.

(10) Patent No.: US 7,383,157 B1
(45) Date of Patent: Jun. 3, 2008

(54) DECISION-MAKING SUPPORT SYSTEM FOR SEWER MAINTENANCE AND CONTROL METHOD THEREOF

(75) Inventors: Sang Woo Park, 102-1203 Doosanweve apartment, 192 Geumgok-dong, Bundang-gu, Seongnam, 463-850, Gyeonggi-do (KR); Gye Woon Ghoi, Incheon (KR); Sung Eun Jung, Gyeonggi-do (KR)

(73) Assignees: Surotech Co., Ltd. (KR); Sang Woo Park (KR)

( * ) Notice: Subject to any disclaimer, the term of this patent is extended or adjusted under 35 U.S.C. 154(b) by 0 days.

(21) Appl. No.: 11/649,042

(22) Filed: Jan. 3, 2007

(51) Int. Cl.
*G06F 15/00* (2006.01)

(52) U.S. Cl. ..... 702/184; 702/188

(58) Field of Classification Search ..... 205/743; 210/93, 600, 608; 702/51, 184, 188
See application file for complete search history.

(56) References Cited

U.S. PATENT DOCUMENTS

2004/0236620 A1* 11/2004 Chauhan et al. ..... 705/9
2007/0083398 A1* 4/2007 Ivey et al. ..... 705/4

FOREIGN PATENT DOCUMENTS

KR 2001044659 * 6/2001

* cited by examiner

*Primary Examiner*—John E. Barlow, Jr.
*Assistant Examiner*—Douglas N Washburn
(74) *Attorney, Agent, or Firm*—John W. Renner; Renner, Otto, Boisselle & Sklar

(57) ABSTRACT

A decision-making support system for a sewer maintenance that includes a graphic user interface that outputs a function selection means of a user and a decision-making support result through a GIS-based graphic screen, a sewage storing unit that stores sewer data including a sewage pipe network data, an aged pipe diagnosis evaluation factor data and a detailed item-based weight data, a sewer maintenance decision-making module that judges a preset object sewer-based aged degree and a sewer exchange priority based on the data stored in the sewage data storing unit and outputs a decision-making support result for the computed sewer maintenance to a user through the graphic user interface, and a sewer maintenance control module that controls the operations of the graphic user interface, the sewage data storing unit and the sewer maintenance decision-making module based on a preset control program.

8 Claims, 7 Drawing Sheets

Fig. 5

Deterioration Pipe Repoting Data Input

Pipe label P2

| | | | |
|---|---|---|---|
| 1 | Laying Area | | City Area |
| 2 | Road | | Main road(above Four - lane) |
| 3 | Laying Year | | within 10 years |
| 4 | Breakage | | OK |
| 5 | Soil condition | Electric resistance rate | 2,500.00 |
| 6 | | Ph | 4.5 |
| 7 | | Soil Kinds | Gravel |
| 8 | internal corrosion rate | n' value | 0.01 |
| 9 | Foundation work | | Concrete foundation |
| 10 | Refilling Soil Condition | | Sand |
| 11 | Joint Method | | OK |
| 12 | valve, divide, connect | | Small |
| 13 | join pipe, attachment pipe | | Yes |

OK Cancel

DECISION-MAKING SUPPORT SYSTEM FOR SEWER MAINTENANCE AND CONTROL METHOD THEREOF

TECHNICAL FIELD

The present invention relates to a decision-making support system for a sewer maintenance and a control method thereof, and in particular to a decision-making support system for a sewer maintenance and a control method thereof capable of computing an aged degree of a sewer based on a preset evaluation factor, wherein a decision-making for a sewer maintenance is supported based on a computed aged degree.

BACKGROUND ART

Generally, when an aged and damaged sewage pipe is left alone, a lot of polluted water such as underground water is inputted into a sewage disposal plant, and the input of the polluted water significantly decreases a dilution and purification function of a sewage disposal plant. In addition, the sewage directly outputted from the damaged sewage pipe pollutes underground water and soil, thus becoming an important factor of environment pollution.

In the maintenance of a sewer, an exchange and maintenance of a facility are performed with respect to a sewer having a problem. The sewer judged to make a problem is previously exchanged and maintained. The above maintenance of the sewer is classified into an exchange, update, maintenance and maintenance management.

In the maintenance of a sewer, one of the important factors is to check status with respect to an aged sewer and to setup a maintenance plan. Therefore, it is urgently needed to develop a sewer management system that may be implemented in such a manner that the aged degree of pipes is computed based on a data accumulation of pipes, history management, and computation of aging factors, and the sewage pipe network is systematically maintained based on the computed aged degree.

DISCLOSURE OF INVENTION

Accordingly, it is an object of the present invention to provide a decision-making support system for a sewer maintenance and a control method thereof capable of supporting a decision-making for a maintenance of an aged sewer, a maintenance timing, a maintenance cost in order to systematically repair and maintain a large size of a sewage pipe network, overcoming the problems encountered in the conventional art.

To achieve the above objects, there is provided a decision-making support system for a sewer maintenance, comprising a graphic user interface that outputs a function selection means of a user and a decision-making support result through a GIS-based graphic screen; a sewage storing unit that stores sewer data including a sewage pipe network data, an aged pipe diagnosis evaluation factor data and a detailed item-based weight data; a sewer maintenance decision-making module that judges a preset object sewer-based aged degree and a sewer exchange priority based on the data stored in the sewage data storing unit and outputs a decision-making support result for the computed sewer maintenance to a user through the graphic user interface; and a sewer maintenance control module that controls the operations of the graphic user interface, the sewage data storing unit and the sewer maintenance decision-making module based on a preset control program.

To achieve the above objects, there is provided a decision-making support control method for a sewer maintenance, comprising a step in which an initial screen is transferred to a user connected, and a main screen is transferred so that a user can select a function-based menu; a step in which a menu screen is transferred so that the user can select an evaluation factor and a detailed factor of the evaluation factor; a step in which one or more than one object pipe way corresponding to an evaluation factor and a detailed factor condition selected from the stored database is judged; a step in which the detailed factor-based weights of the object pipe way are summed, for thereby computing an aged degree of each object pipe way; a step in which a sewer maintenance priority is judged based on the computed object pipe way-based aged degree; and a step in which the screen of the object pipe way-based aged degree and the sewer maintenance priority computed in the above step is transferred.

To achieve the above objects, there is provided a decision-making support control method for a sewer maintenance, comprising a step in which an initial screen is transferred to a user connected, and a main screen is transferred so that a user selects a function-based menu; a step in which a sewage pipe network screen is transferred so that a user designates an object pipe way; a step in which an object pipe way selected by a user is judged; a step in which an aged degree of the object pipe way is computed by accessing an evaluation factor, a detailed factor and a detailed factor-based weight data of the object pipe way from the stored database; and a step in which a screen of the aged degree of the object pipe way computed in the above step is transferred.

BRIEF DESCRIPTION OF DRAWINGS

The present invention will become better understood with reference to the accompanying drawings which are given only by way of illustration and thus are not limitative of the present invention, wherein;

FIGS. 4 through 6 are views illustrating the output screens of a decision-making support system for a sewer maintenance according to a preferred embodiment of the present invention.

BEST MODE FOR CARRYING OUT THE INVENTION

The preferred embodiments of the present invention will be described with reference to the accompanying drawings. In the descriptions of the present invention, if it is judged that the detailed descriptions concerning the prior art or constriction are deemed to make the gist of the present invention obscure, the detailed descriptions will be omitted.

Figure 1:
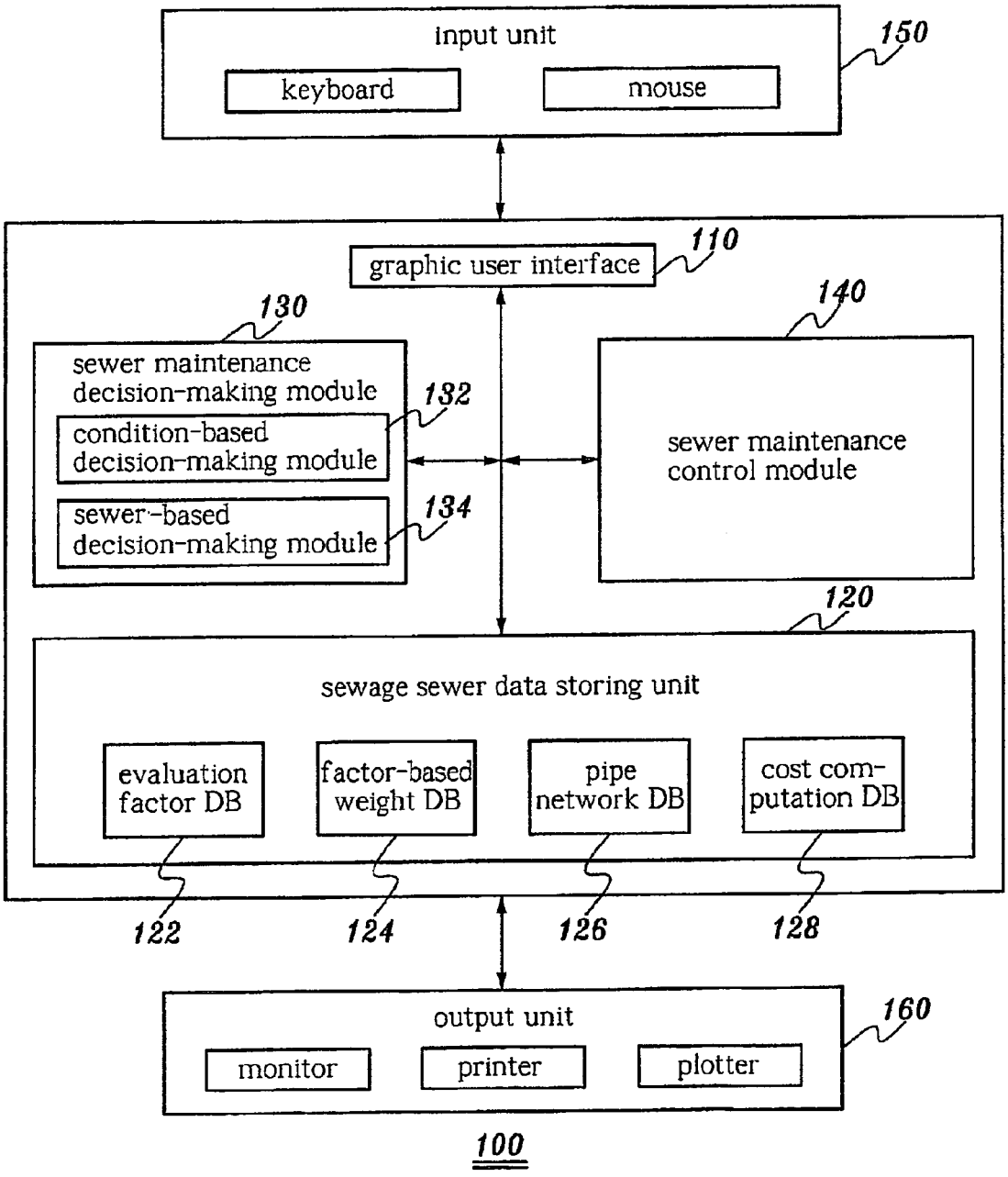
FIG. 1 is a view illustrating the construction of a decision-making support system for a sewer maintenance according to a preferred embodiment of the present invention.

FIG. 1 is a view illustrating the construction of a decision-making support system for a sewer maintenance according to a preferred embodiment of the present invention.

As shown therein, a sewer maintenance decision-making support system 100 according to a preferred embodiment of the present invention includes a graphic user interface 110, a sewage data storing unit 120, a sewer maintenance decision-making module 130, and a sewer maintenance control module 140. In addition, an input unit 150 and an output unit 160 are further provided.

(1) Graphic User Interface

The graphic user interface 110 is an operation system capable of outputting a user's function selection and a decision-making support result through a GIS-based graphic screen.

As a user's function selection unit, a pointer, an icon, menu bar, etc. may be used. The decision-making support result may be outputted on a preset screen in a type of a character, table, graph, etc.

(2). Sewage Data Storing Unit

The sewage data storing unit 120 is capable of storing a sewer data including a sewage pipe network data, an aged pipe diagnosis evaluation factor data, and a detailed item-based weight data.

The data stored in the sewage data storing unit 120 includes a basic data inputted when setting up a system, a real time data collected and updated in real time, and a manual data inputted by an operator based on a data change.

The sewage data storing unit 120 includes an evaluation factor database 122, a factor-based weight database 124, a pipe network database 126, and a cost computation database.

Preferably, the sewage data storing unit 120 is implemented based on a large scale database management system (DBMS) such as Oracle, MySQL so that a large size data such as an image data, etc. is stored and accessed.

The evaluation factor database 122 stores an aged pipe evaluation factor data including a preset evaluation factor and each evaluation factor-based detailed factor. With the evaluation factor of the aged pipe evaluation factor data, it is possible to set sewer-based burying area, road, years of burial, soil condition, inner corrosion degree, basic construction method, pipe diameter, joint method, number of divides, level of underground water, I/I ratio, flow speed in pipe, etc. In addition, with the evaluation factor-based detailed factors, it is possible to set a plurality of detailed factors corresponding to each evaluation factor. For example, detailed factors such as industrial area, buried area, coastal area, city area and other area with respect to the buried area that is an evaluation factor are set, and it is possible to set a detailed factor such as highway, industrial road, main trunk line road, other road, unpaved road, etc. with respect to a road that is an evaluation factor.

The factor-based weight database 124 stores a detailed factor-based weight data of the aged pipe evaluation factor data.

For example, two points may be set as weight for industrial area, buried area and coastal area among the detailed factors of the burial area that is an evaluation factor, and four points may be set as weight for city area, and six points may be set as weight for other area. Two points may be set as weight for highway and industrial road among the detailed factors of road that is an evaluation factor, and four points may be set as weight for main trunk line road, and five points may be set as weight for other roads, and six points may be set as weight for unpaved road.

Tables 1 through 6 show the examples of the tables concerning the aged pipe evaluation factor data, evaluation factor-based detailed factor data and detailed factor-based weight data stored in the evaluation factor database 122 and the factor-based weight database 124.

TABLE 1

| Evaluation factor | Detailed factors | Factor-based weight |
|---|---|---|
| Buried area | Industrial area, buried area, costal area | 2 |
| | City area | 4 |
| | Other areas | 6 |
| Road | Highway, industrial road | 2 |
| | Main trunk line road (more than 4 lines) | 4 |
| | Other road | 5 |
| | Unpaved road | 6 |
| Years of burial | Within 10 years | 6 |
| | 10~15 years | 4 |
| | 15~20 years | 2 |
| | Above 20 years | 0 |
| damages | Good | 6 |
| | Common | 4 |
| | Too bad | 2 |

TABLE 2

| Evaluation factor | Detailed factors | Factor-based weight |
|---|---|---|
| Condition of soil | | |
| Electrical resistance ratio | Below 700 | 0 |
| | 700~1000 | 1 |
| | 1000~1500 | 2 |
| | 1500~2500 | 3 |
| | Above 2500 | 4 |
| PH | Below 4 | 0 |
| | 4~6 | 1 |
| | 6~8.5 | 2 |
| | Above 8.5 | 1 |
| Kinds of soil | Gravel | 2 |
| | Sand | 4 |
| | Silt | 6 |
| | Clay | 8 |

TABLE 3

| Evaluation factor | Detailed factors | Factor-based weight |
|---|---|---|
| Inner corrosion degree (n value) | Below 0.02 | 0 |
| | 0.017 | 3 |
| | 0.015 | 7 |
| | 0.013 | 10 |
| Basic construction method | Conc. Basic or pile basic | 5 |
| | Sand soil basic | 3 |
| | Ground flattening | 2 |
| Reburying soil condition | Sand | 3 |
| | Silt/loam | 2 |
| | clay | 1 |

TABLE 4

| Evaluation factor | Detailed factors | Factor-based weight |
|---|---|---|
| Pipe diameter | Below 500 mm | 6 |
| | 500~1000 | 4 |
| | 1000~1500 | 2 |
| | Above 1500 | 0 |
| Joint method | Good | 4 |
| | Common | 2 |
| | Bad | 2 |
| Valve, divide, connection pipe | Less | 4 |
| | Common | 2 |
| | Much | 0 |
| Connection pipe and accessory pipe | Provided | 0 |
| | Not provided | 2 |

TABLE 5

| Evaluation factor | Detailed factors | Factor-based weight |
|---|---|---|
| I/I ratio | Below 5% | 7 |
| | Below 10% | 4 |
| | Below 30% | 3 |
| | 31~100% | 1 |

Here. I/I ratio is computer based on (conversion I/I of pipe/total flow amount of pipe)

TABLE 6

| Evaluation factor | Detailed factors | Factor-based weight |
|---|---|---|
| Flow speed state of pipe | Full pipe | 0 |
| | Pipe with slow flow (below 0.3 m/sec) | 0 |
| | Normal pipe | 5 |

The slow speed of the pipe is obtained based a result of pipe-based unsteady flow analysis.

The pipe network database 126 stores sewage pipe network data including a graphic data such as a sewage pipe network map, sewage history map, city planning map, rain and drainage area map, sewage and drainage area map, etc., an attribute data related thereto, an input water/flow-in water/leakage data, and sewer over flow water data. As the graphic data and attribute data, a data collected through a computation work like sewage facility value map construction status, and it includes an inter relationship.

The cost computation database stores a pipe way-based cost computation data such as a pipe way exchange cost, a pipe way repair cost, a pipe way maintenance cost, etc. The pipe way-based cost computation data is stored based on various variables such as area, timing, facility characteristic, number of workers, etc.

(3) Decision-Making Module for Sewer Maintenance

The sewer maintenance decision-making module 130 judges a sewer-based aged degree and a sewer exchange priority from the data stored in the sewage data storing unit and outputs a decision-making support result for the computed sewer maintenance to a user through the graphic user interface.

The sewer maintenance decision-making module 130 is formed of a condition-based decision-making module 132 and the pipe way-based decision-making module 134.

The condition-based decision-making module 132 outputs an object pipe way corresponding to the condition selected by the user through the graphic user interface and judges the object pipe way-based aged degree and computes the sewer maintenance priority and the sewer maintenance cost.

The pipe way-based decision-making module 134 judges the aged degree of a certain pipe way selected by the user and computes the sewer maintenance cost of the sewer.

(4) Sewer Maintenance Control Module

The sewer maintenance control module 140 controls an operation and data exchange of a graphic user interface, sewage data storing unit and sewer maintenance decision-making module based on a preset control program.

(5) Input Unit

The input unit 150 is a unit in which a user inputs data and performs a designation of an object pipe way and selects an evaluation factor. The input unit 150 includes a typical input unit such as a keyboard, a mouse, etc.

(6) Output Unit

The output unit 160 is an output device for providing the user with various screens and outputting the computed decision-making support result to the outside so that a user can recognize. The output unit 160 includes an output device such as a monitor, a printer, a plotter, etc.

Figure 2:
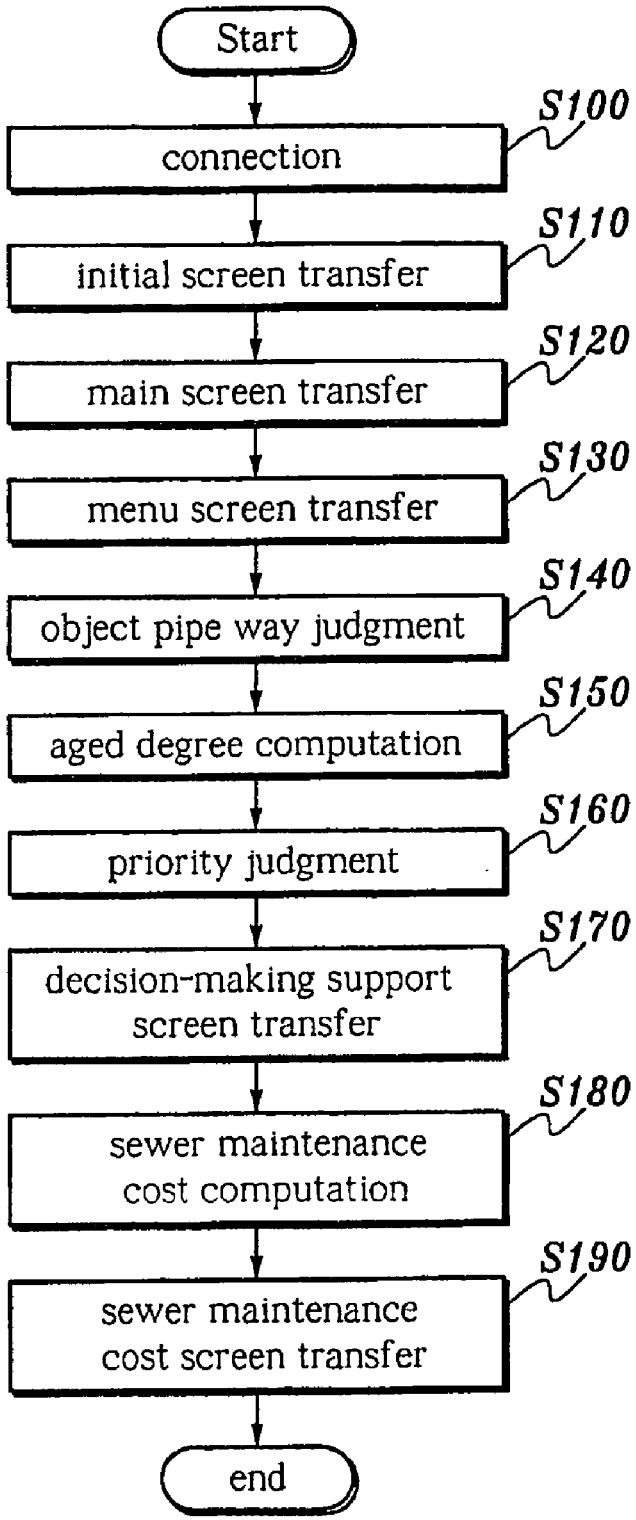
FIG. 2 is a flow chart of a control method of a decision-making support system for a sewer maintenance according to a first embodiment of the present invention.

FIG. 2 is a flow chart of a control method of a decision-making support system for a sewer maintenance according to a first embodiment of the present invention.

As shown therein, the control method of a decision-making support system for a sewer maintenance according to a first embodiment of the present invention includes connection/initial screen transfer/main screen transfer steps S100 through S120, a menu screen transfer step S130, an object pipe way judging step S140, an aged degree computation step S150, a priority judging step S160, a decision-making support screen transfer step S170. There are further provided a sewer maintenance cost computation step S180 and a sewer maintenance cost screen transfer step S190.

(1-1) Connection/Initial Screen Transfer/Main Screen Transfer Steps S100 Through S120

The connection/initial screen transfer/main screen transfer steps S100 through S120 correspond to steps for transferring an initial screen to a user connected, so that the user selects a function-based menu.

(1-2) Menu Screen Transfer Step S130

The menu screen transfer step S130 is a step for transferring a menu screen so that the user selects an evaluation factor and the detailed factors of the evaluation factor.

The menu screen may be implemented as shown in FIG. 5. Namely, evaluation factors such as a buried area, a burial map, etc. are arranged on the right upper side of the screen, and a plurality of detailed factors are outputted in the right side of the selected evaluation factor. The user designates a desired evaluation factor among the evaluation factors and selects a detailed factor of the designated evaluation factors. The user selects a comparison condition (and, or) and presses a LIST button or an inquiry button.

(1-3) Object Pipe Way Judging Step S140

The object pipe way judging step S140 is a step for judging one or more than one object pipe way corresponding to the evaluation factor or detailed factor condition selected from the stored database.

Namely, as shown in FIG. 5, when the user selects a buried area, a buried year, a damage and an electrical resistance as an evaluation factor and selects an industrial area, 10~5 years, common, and below 700 as the evaluation factor-based detailed factor, the pipe way corresponding to the evaluation factor and detailed factor condition from the stored database is searched.

(1-4) Aged Degree Computation Step S150

The aged degree computation step S150 is a step for summing the detailed factor-based weight of an object pipe way and computing an aged degree of each object pipe way.

Namely, in the aged degree computation step S150, each detailed factor-based weight of the object pipe way judged in the object pipe way judging step S140 is summed, and the object pipe way-based aged degree is computed.

(1-5) Priority Judging Step S160

The priority judging step S160 is a step for judging the sewer maintenance priority based on the computed object pipe way-based aged degree.

Namely, in the priority judging step S160, each pipe way-based aged degree is compared and is arranged based on the high and low values of the aged degree, and each pipe way is divided into an instant exchange state, an exchange request state, a maintenance request state, and a current state maintenance.

(1-6) Decision-Making Support Screen Transfer Step S170

The decision-making support screen transfer step S170 is a step for transferring a decision-making support screen that shows an object pipe way-based aged degree and a sewer maintenance priority computed in the aged degree computation step S150 and the priority judging step S160.

Namely, in the decision-making support screen transfer step S170, the decision-making support result value including the computed object pipe way-based aged degree and the sewer maintenance priority is outputted in a screen type preset so that the user can recognize.

(1-7) Sewer Maintenance Cost Computation Step S180

The sewer maintenance cost computation step S180 is a step for computing the sewer maintenance cost based on the computed object pipe way-based aged degree.

Namely, in the sewer maintenance cost computation step S180, the estimated cost is computed based on the sewer maintenance from the pipe way-based const computation data including the aged degree and pipe way exchange cost of the computed object pipe way, the pipe way repair cost, and the pipe way maintenance cost.

(1-8) Sewer Maintenance Cost Screen Transfer Step S190

The sewer maintenance cost screen transfer step S190 is a step for transferring the screen of the object pipe way-based sewer maintenance cost computed in the sewer maintenance cost computation step S180.

Figure 3:
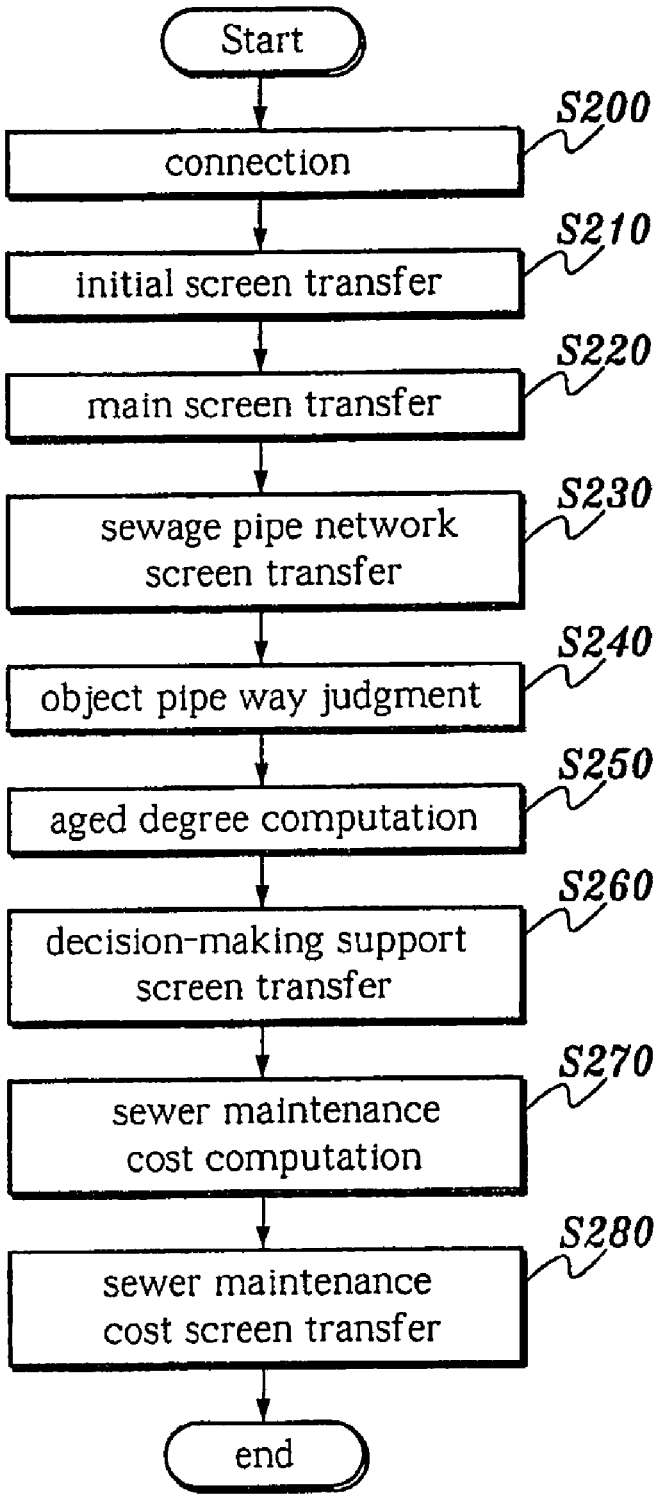
FIG. 3 is a flow chart of a control method of a decision-making support system for a sewer maintenance according to a second embodiment of the present invention.
Figure 4:
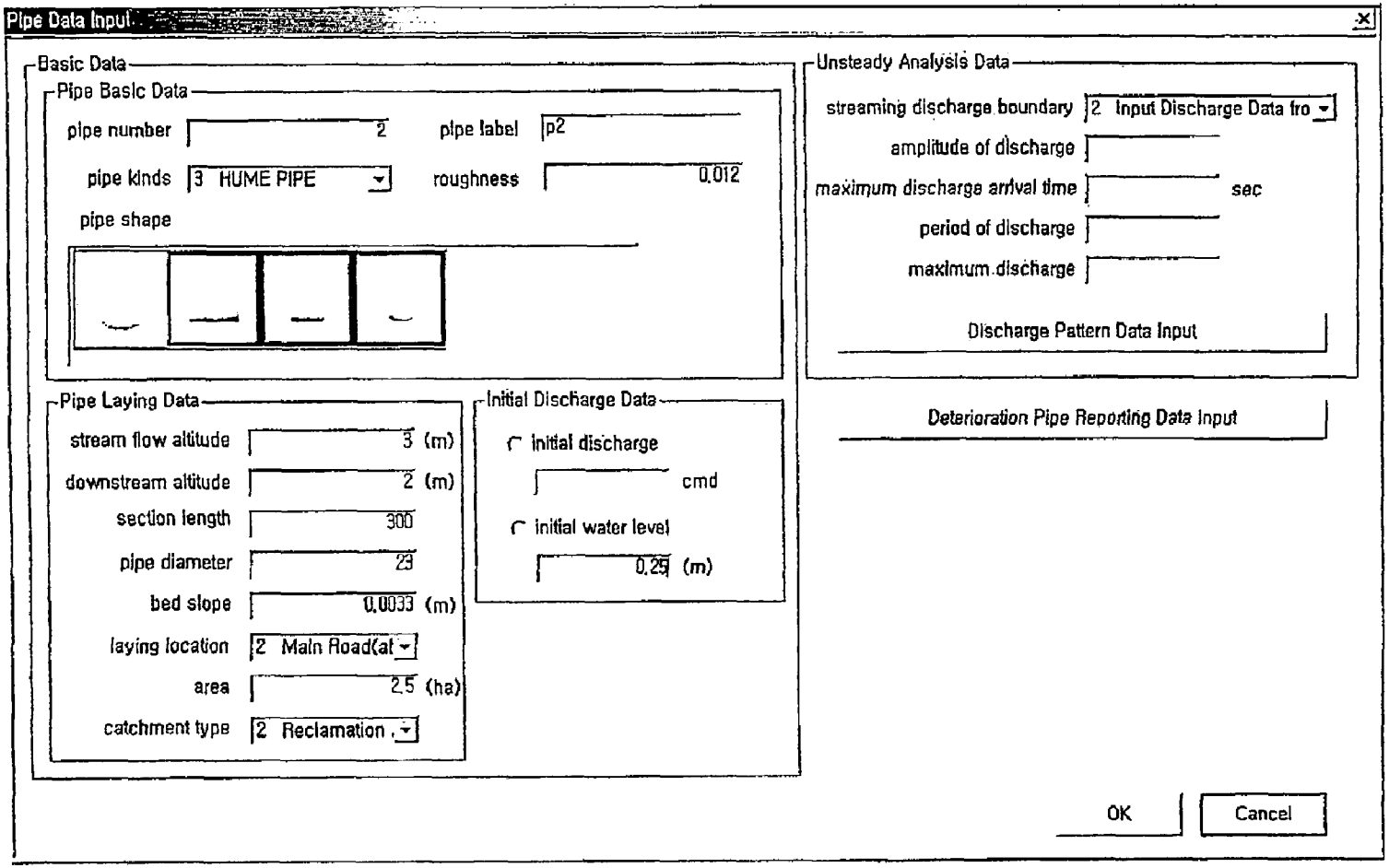

FIG. 3 is a flow chart of a control method of a sewer maintenance decision-making support system according to a second embodiment of the present invention.

As shown in FIG. 3, the control method of the sewer maintenance decision-making support system according to a second embodiment of the present invention includes a connection/initial screen transfer/main screen transfer steps S200 through S220, a sewage pipe network screen transfer step S230, an object pipe way judging step S240, an aged degree computation step S250, and a decision-making support screen transfer step S260. There are further provided a sewer maintenance cost computation step S270 and a sewer maintenance cost screen transfer step S280.

(2-1) Connection/Initial Screen Transfer/Main Screen Transfer Steps S200 Through S220

The connection/initial screen transfer/main screen transfer steps S200 through S220 are steps for transferring an initial screen to the user connected, and transferring a main screen to the user so that the user can select a function-based menu.

(2-2) Sewage Pipe Network Screen Transfer Step S230

The sewage pipe network screen transfer step S230 is a step for transferring a sewage pipe network screen so that the user can designate an object pipe way.

Figure 6:
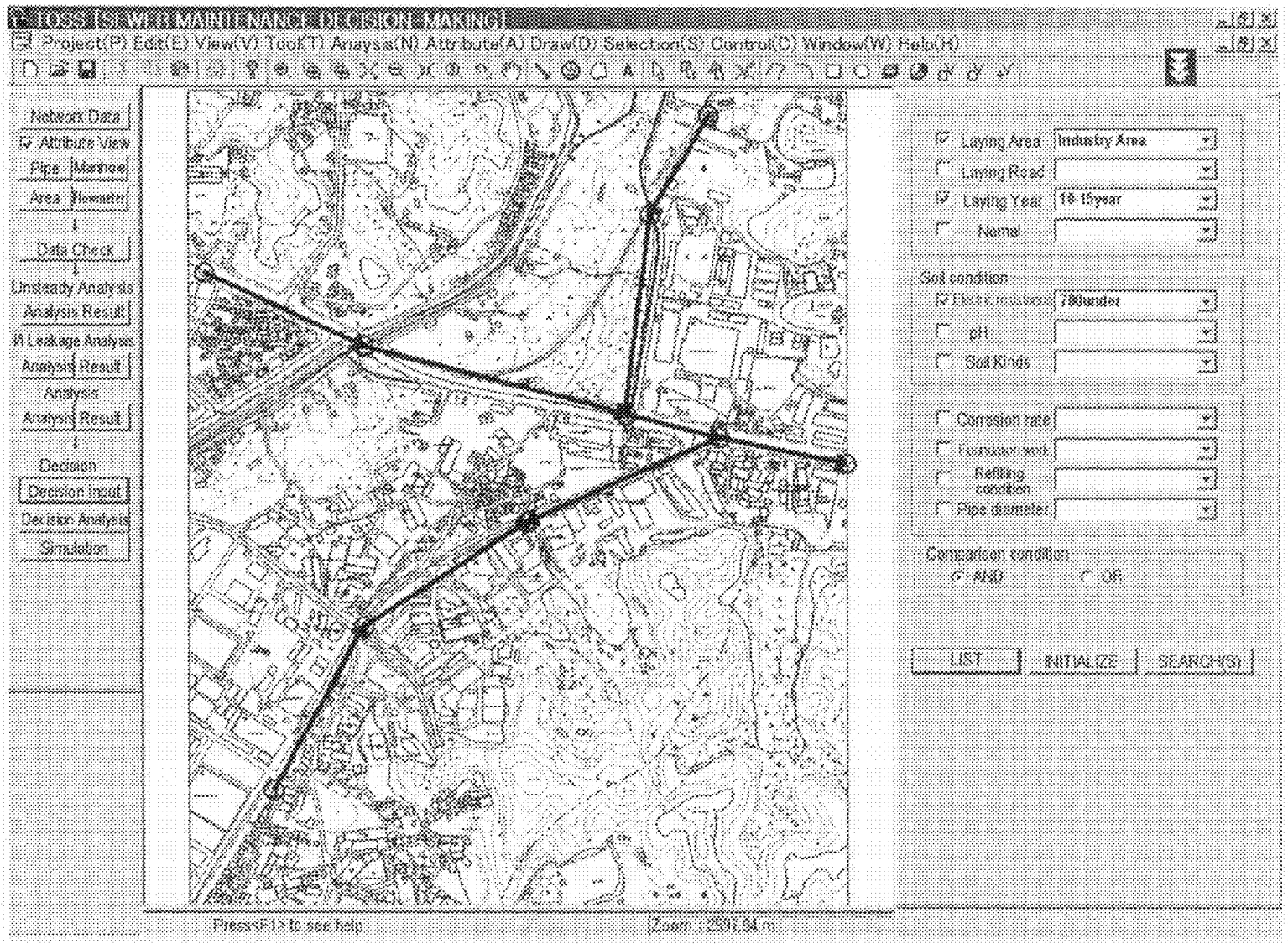
Figure 7:
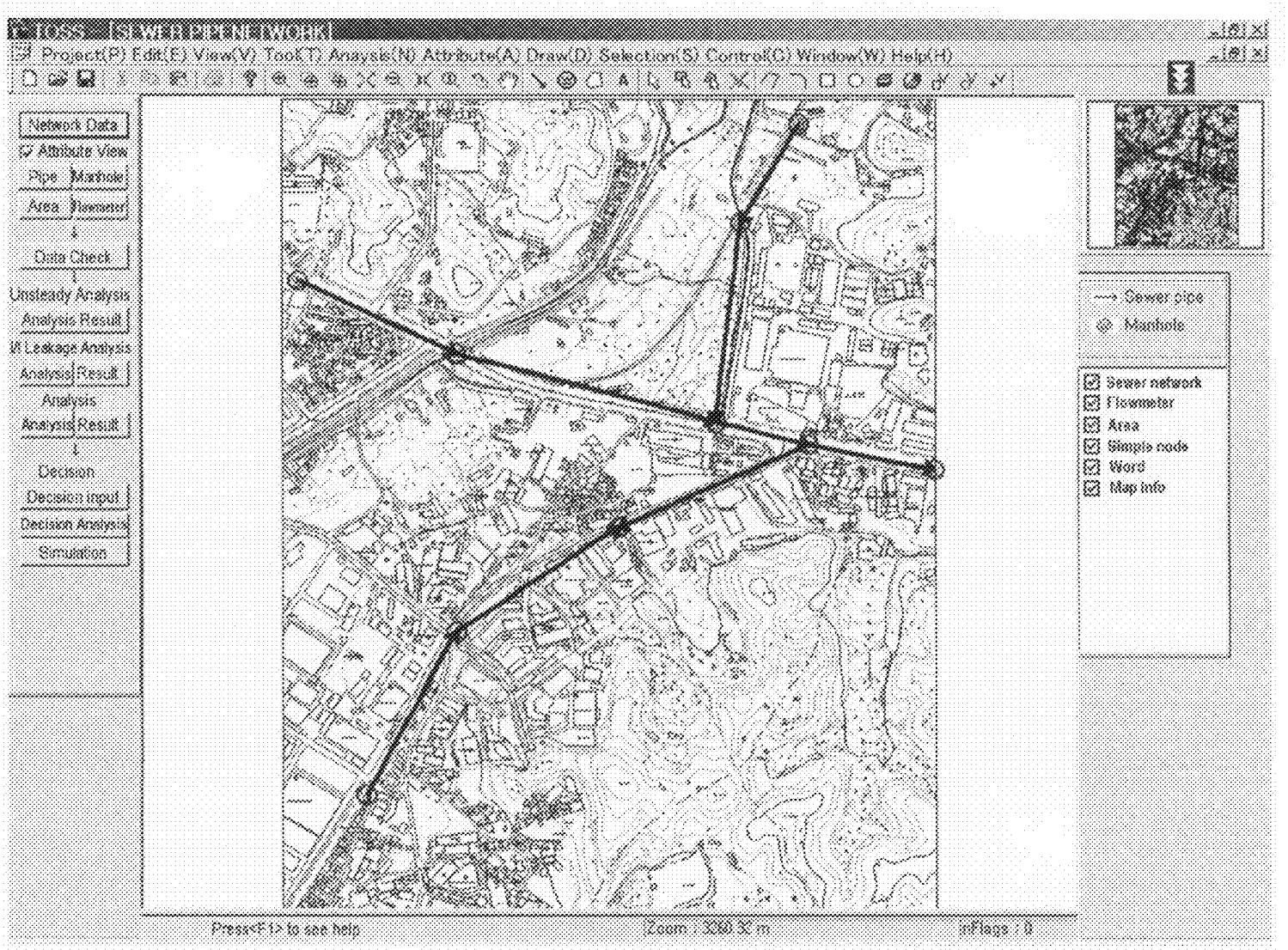

The sewage pipe network screen may be implemented as shown in FIG. 6. Namely, the sewage pipe network map of the area designated by the user is displayed on the center of the screen, and the user can select a pipe way of a certain section using a pointer.

(2-3) Object Pipe Way Judging Step S240

The object pipe way judging step S240 is a step for judging whether the object pipe way selected by the user is a certain pipe way.

(2-4) Aged Degree Computation Step S250

The aged degree computation step S250 is a step for computing an aged degree by accessing an evaluation factor, a detailed factor, a detailed factor-based weight data of an object pipe way from the stored database.

(2-5) Decision-Making Support Screen Transfer Step S260

The decision-making support screen transfer step S260 is a step for transferring a decision-making support screen showing an aged degree of the object pipe way computed in the aged degree computation step S250.

(2-6) Sewer Maintenance Cost Computation Step S270

The sewer maintenance cost computation step S270 is a step for computing the sewer maintenance cost based on the aged degree of the computed object pipe way.

Namely, the sewer maintenance cost computation step S270 is a step for computing an estimated cost based on the sewer maintenance from an aged degree data of the computed object pipe way and a sewer-based cost computation data including a pipe way exchange cost, a pipe way repair cost and a pipe way maintenance cost.

(2-7) Sewer Maintenance Cost Screen Transfer Step S280

The sewer maintenance cost screen transfer step S280 is a step for transferring a screen of a sewer maintenance cost of an object pipe way computed in the sewer maintenance cost computation step S270.

INDUSTRIAL APPLICABILITY

As described above, the decision-making support system for a sewer maintenance according to a preferred embodiment of the present invention is capable of computing an aged degree of a pipe way forming a sewage pipe network and determining a maintenance priority. In addition, it is possible to accurately predict a cost and effect based on a sewer maintenance and achieve a systematic sewage pipe network management and maintenance.

In addition, in the decision-making support system for a sewer maintenance and a control method of the same according to the present invention, various factors affecting an aging of a pipe way are quantized, for thereby computing an objective aged degree. Therefore, it is possible to obtain a reliable sewer maintenance decision-making data.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A decision-making support system for sewer maintenance, comprising:

a graphic user interface that outputs a function selection means of a user and a decision-making support result through a GIS-based graphic screen;

a sewage storing unit that stores sewer data including a sewage pipe network data, an aged pipe diagnosis evaluation factor data and a detailed item-based weight data;

a sewer maintenance decision-making module that judges a preset object sewer-based aged degree and a sewer exchange priority based on the data stored in the sewage data storing unit and outputs a decision-making support result for the computed sewer maintenance to a user through the graphic user interface; and a sewer maintenance control module that controls the operations of the graphic user interface, the sewage data storing unit and the sewer maintenance decision-making module based on a preset control program;

wherein said sewage data storing unit includes:

an evaluation factor database that stores an aged pipe evaluation factor including a preset evaluation factor and each evaluation factor-based detailed factor;

a factor-based weight database that stores a detailed factor-based weight data of the aged pipe evaluation data;

a pipe network database that stores a sewage pipe network data formed of a graphic data; and a cost computation database that stores a pipe way exchange cost, a pipe way update cost, and a pipe way repair cost.

2. The system of claim 1, wherein said aged pipe evaluation factor data includes at least one among a sewer-based buried area, a road, a buried year, a damage state, a soil condition, an inner corrosion degree, a basic construction method, a soil condition, a pipe diameter, a joint method, the number of divides, a underground water level, an I/I ratio, and a pipe flow speed state.

3. A decision-making support system for sewer maintenance, comprising:

a graphic user interface that outputs a function selection means of a user and a decision-making support result through a GIS-based graphic screen;

a sewage storing unit that stores sewer data including a sewage pipe network data, an aged pipe diagnosis evaluation factor data and a detailed item-based weight data;

a sewer maintenance decision-making module that judges a preset object sewer-based aged degree and a sewer exchange priority based on the data stored in the sewage data storing unit and outputs a decision-making support result for the computed sewer maintenance to a user through the graphic user interface; and a sewer maintenance control module that controls the operations of the graphic user interface, the sewage data storing unit and the sewer maintenance decision-making module based on a preset control program;

wherein said sewer data of the sewage data storing unit further includes a pipe way exchange cost computation data, and said sewer maintenance decision-making module computes a pipe way maintenance cost based on the data from the sewage data storing unit and outputs to the user through the graphic user interface.

4. The system of claim 3, wherein said sewer maintenance decision-making module includes:

a condition-based decision-making module that outputs an object pipe way corresponding to a condition selected by a user through the graphic user interface, and judges an object pipe way-based aged degree and computes a sewer maintenance priority and sewer maintenance cost; and a sewer-based decision-making module that judges an aged degree of a certain pipe way selected by a user and computes a sewer maintenance cost of the pipe way.

5. A decision-making support control method for a sewer maintenance, comprising:

a step in which an initial screen is transferred to a user connected, and a main screen is transferred so that a user can select a function-based menu;

a step in which a menu screen is transferred so that the user can select an evaluation factor and a detailed factor of the evaluation factor;

a step in which one or more than one object pipe way corresponding to an evaluation factor and a detailed factor condition selected from a stored database is judged;

a step in which the detailed factor-based weights of the object pipe way are summed, for thereby computing an aged degree of each object pipe way;

a step in which a sewer maintenance priority is judged based on the computed object pipe way-based aged degree; and a step in which a screen of the object pipe way-based aged degree and the sewer maintenance priority judged based on the computed object pipe way-based aged degree in the above step is transferred to an output unit.

6. The method of claim 5, further comprising:

a step in which a sewer maintenance cost is computed based on the computed object pipe way aged degree; and a step in which a screen of the object pipe way-based sewer maintenance cost computed in the above step is transferred to an output unit.

7. A decision-making support control method for a sewer maintenance, comprising:

a step in which an initial screen is transferred to a user connected, and a main screen is transferred so that a user selects a function-based menu;

a step in which a sewage pipe network screen is transferred so that a user designates an object pipe way;

a step in which an object pipe way selected by a user is judged;

a step in which an aged degree of the object pipe way is computed by accessing an evaluation factor, a detailed factor and a detailed factor-based weight data of the object pipe way from a stored database; and a step in which a screen of the aged degree of the object pipe way computed in the above step is transferred to an output unit.

8. The method of claim 7, further comprising:

a step in which a sewer maintenance cost is computed based on an aged degree of the computed object pipe way; and a step in which a screen of a sewer maintenance cost of the object pipe way computed in the above step is transferred to an output unit.

* * * * *